US010654042B2

(12) United States Patent
Rethwisch et al.

(10) Patent No.: US 10,654,042 B2
(45) Date of Patent: May 19, 2020

(54) DEVICE FOR PROVIDING PIPETTE TIPS

(71) Applicant: Eppendorf AG, Hamburg (DE)

(72) Inventors: Hanna Rethwisch, Hamburg (DE); Frank Horstmann, Lensahn (DE); Matthias Haak, Oldenburg (DE)

(73) Assignee: Eppendorf AG, Hamburg (DE)

( * ) Notice: Subject to any disclaimer, the term of this patent is extended or adjusted under 35 U.S.C. 154(b) by 0 days.

(21) Appl. No.: 16/348,920

(22) PCT Filed: Oct. 23, 2017

(86) PCT No.: PCT/EP2017/076998

§ 371 (c)(1),
(2) Date: May 10, 2019

(87) PCT Pub. No.: WO2018/086850

PCT Pub. Date: May 17, 2018

(65) Prior Publication Data

US 2019/0275528 A1 Sep. 12, 2019

(30) Foreign Application Priority Data

Nov. 14, 2016 (EP) ..... 16198650

(51) Int. Cl.
*B01L 9/00* (2006.01)
*B01L 3/02* (2006.01)
*B65D 25/10* (2006.01)

(52) U.S. Cl.
CPC ..... *B01L 9/543* (2013.01); *B01L 3/0275* (2013.01); *B65D 25/108* (2013.01);
(Continued)

(58) Field of Classification Search
CPC ..... B01L 9/543; B01L 2300/0858; B01L 2300/043; B01L 3/0275
See application file for complete search history.

(56) References Cited

U.S. PATENT DOCUMENTS 5,366,088 A 11/1994 Hill et al.
6,019,225 A * 2/2000 Kalmakis ..... B01L 9/543 206/563

(Continued)

FOREIGN PATENT DOCUMENTS

EP 2535109 A2 12/2012
EP 2789389 B1 7/2015

(Continued)

*Primary Examiner* — Brian R Gordon
(74) *Attorney, Agent, or Firm* — Vidas, Arrett & Steinkraus, P.A.

(57) ABSTRACT

A device for pipette tips having a refill pack, a plate having holes, pipette tips, a shell below the plate, an inner lid above the plate which has a base and side walls and a latch; a holder having a bottom; an outer lid having a base and side walls; a pivotal connection for the lid and holder; a support projecting from a side wall engaging the bottom of a lid side wall; a second latch having a support which latches with the first latch; an unlocking button having an actuator on the outside of the second lid side wall and a pressing element on the inside of the second lid side wall which may be pressed against the outside of the first lid side wall to deform the first lid side wall and undo the latching between the first and second latches.

15 Claims, 19 Drawing Sheets

(52) U.S. Cl.
CPC ..... *B01L 2200/02* (2013.01); *B01L 2200/04* (2013.01); *B01L 2200/141* (2013.01); *B01L 2300/043* (2013.01); *B01L 2300/0858* (2013.01)

(56) References Cited

U.S. PATENT DOCUMENTS 6,328,933 B1 * 12/2001 Labriola ..... B01L 9/543 206/558
6,534,015 B1 * 3/2003 Viot ..... B01L 9/543 422/564
2005/0133512 A1 * 6/2005 Prokopp ..... B01L 9/543 220/601
2005/0150808 A1 * 7/2005 Sarna ..... B01L 9/543 206/562
2006/0045815 A1 * 3/2006 Hovatter ..... B01L 9/543 422/536
2006/0093530 A1 * 5/2006 Ueda ..... B01L 9/543 422/400
2008/0240999 A1 * 10/2008 Timpson ..... B01L 9/543 422/400
2010/0089938 A1 * 4/2010 Motadel ..... B01L 9/543 221/1
2011/0236278 A1 * 9/2011 Motadel ..... B01L 9/543 422/560
2012/0328489 A1 12/2012 Beese et al.
2014/0271412 A1 * 9/2014 Hovatter ..... B65D 43/22 422/564
2019/0009277 A1 * 1/2019 Kofler ..... B01L 9/543
2019/0299217 A1 * 10/2019 Motadel ..... B01L 9/543

FOREIGN PATENT DOCUMENTS

WO 92/01514 A1 2/1992
WO 00/51899 A1 9/2000

* cited by examiner

DEVICE FOR PROVIDING PIPETTE TIPS

CROSS-REFERENCE TO RELATED APPLICATIONS

This application is a National Stage of PCT/EP2017/076998 filed on Oct. 23, 2017, the contents of which is hereby incorporated by reference.

FIELD OF THE INVENTION

The invention relates to a device for providing pipette tips.

BACKGROUND

Pipettes tips are small tubes made of plastic which are used in the laboratory for metering liquid samples, preferably within the range of 0.1 μL to 100 mlL. They have a bottom opening for liquid and a top opening for air, and the cross-section of the pipette tips generally increases from the bottom aperture opening toward the top aperture opening.

To meter liquid, the top end of the pipette tip is connected to a pipette such that the top opening is joined to a pipette displacement apparatus for air. The opening of the pipette tip is clamped onto a shoulder of the pipette, or clamped in a hole of the pipette. A channel terminates in the face of the shoulder or respectively in the base of the hole, and the channel is connected to the pipette displacement apparatus. The displacement apparatus of a piston stroke pipette is a cylinder with a piston which can move therein. With the assistance of the displacement apparatus, an air volume is shifted such that a specific amount of liquid is drawn into the pipette tip and discharged therefrom. Fixed volume pipettes with a constant metering volume have a constant displacement, and variable pipettes with an adjustable metering volume have an adjustable displacement. With direct displacement pipettes, a piston is integrated in the pipette tip which is driven by the displacement apparatus.

After being used, the pipette tip is removed from its seat on the pipette, for which purpose the pipette can have an ejector that, upon being actuated, pushes the pipette tip off of its seat. Then the pipette can accommodate a new pipette tip. This prevents sample liquid from one metering from carrying over into a subsequent metering.

In order to affix pipette tips on the seat of a pipette, pipette tips are provided on devices for providing pipette tips. These devices have a perforated plate that is also termed a "tray" or "wafer".

Furthermore, these devices comprise a bottom part which is designed as a box that is closed at the bottom and open at the top, or a rectangular frame (also termed a "rack") that is open at the bottom and the top. A perforated plate equipped with pipette tips can be mounted from above on a mounting edge of an insertion opening in the bottom part so that the pipette tips extend into a holder in the bottom part.

The pipette tips can be removed from a device for providing pipette tips by pressing the seat of a single channel pipette, or the seats of a multi-channel pipette, onto or into the top ends of the pipette tips, individually or several at the same time.

Devices for providing pipette tips are known in which the bottom part can be reused after all of the pipette tips have been removed. For this, the perforated plate is removed, possibly together with the used pipette tips that have been reinserted therein, and discarded. With the assistance of refill packs, the holder is equipped with fresh pipette tips. The refill packs can comprise several perforated plates that are equipped with pipette tips. Refill packs are known, for example, with one or more perforated plates filled with pipette tips arranged in folding boxes or cardboard frames, or in simple plastic boxes or plastic frames.

With the refill packs according to WO 92/01514 A1, U.S. Pat. No. 5,366,088 and WO 00/518899 A1, a perforated plate equipped with pipette tips is releasably attached to the top edge of a shell made of plastic, wherein the pipette tips extend into the shell. An additional perforated plate is arranged thereabove with pipette tips that extend into the pipette tips in the bottom perforated plate and that are releasably attached at the edge to the bottom perforated plate. Additional plates with pipette tips are correspondingly arranged thereabove, and the arrangement is covered at the top by a lid made of plastic which is releasably attached to the topmost perforated plate.

In designs of these refill packs, the lid can be used to transfer the perforated plates equipped with pipette tips from the refill stack into the holder, and can then be placed on the topmost perforated plate of the refill stack in order to protect the opened refill pack.

The disadvantage of these refill packs is that the pipette tips are at least partially unprotected and can become contaminated when moving the perforated plates to a holder.

Furthermore, sterile pipette tips are offered. In applications in which sterility is important, they must not be contaminated before use (or they must be autoclaved before use). Filter pipette tips are generally offered sterile because the filter materials do not withstand the temperatures during autoclaving.

Sterile pipette tips are handled in robust disposable boxes to be worked through, and not in refill packs for moving into a box or frame. In contrast to reusable boxes, disposable boxes are disposed of after all of the pipette tips have been removed. They have a complex design and are therefore expensive to produce, and a large amount of packaging waste is generated by the user.

EP 2 535 109 A2 describes a device for providing pipette tips which comprises a refill pack and a holder. The refill pack has a perforated plate with a plurality of holes, pipette tips inserted into the holes, a shell that covers the pipette tips at the bottom with a rigidity up to 300 N/mm, and a cover that covers the pipette tips at the top. The holder has a seat for inserting the refill pack. The refill pack and holder have means for bracing that brace the refill pack inserted into the seat. By means of the shell and the cover, the pipette tips inserted into the perforated plate are covered at the top and bottom and protected from contamination when refilling the holder. The rigidity of the shell is so low that it is easily producible using little material. The forces when pipette tips are received by a pipette are deflected into the holder by the bracing means. One design has means for latching the cover and shell. Furthermore, the holder has a bottom part with the seat and a lid that covers the refill pack inserted therein and has an articulated connection with the bottom part. The lid of the holder and the cover of the refill pack have means for latching that can be latched to each other by closing the lid when the refill pack is inserted into the seat.

When the lid is opened, the cover is also opened since the force for releasing the latching between the lid and cover exceeds the force for releasing the latching between the cover and shell. The protection of the refill pack from contaminants is improved, and the pipette tips are protected from contact with the lid of the holder. The disadvantage is that the user must put his hand inside the lid before inserting a new refill pack in order to release the latching with the cover. A comparatively high force must be exerted for this. This makes handling difficult and can cause the holder to become contaminated.

GENERAL DESCRIPTION OF THE INVENTION

Against this background, the object of the invention is to create a device for providing pipette tips that facilitates the exchange of refill packs and further reduces the risk of contamination.

The object is achieved by a device with the features of claim 1. Advantageous embodiments of the device are specified in the dependent claims.

The device according to the invention for providing pipette tips has

- a refill pack comprising
  - a perforated plate with a plurality of holes,
  - pipette tips inserted in the holes,
  - a shell covering the pipette tips below the perforated plate,
  - an inner lid consisting of an elastic material covering the pipette tips above the perforated plate that has a first lid base and first lid side walls projecting downward from the edges of the first lid base, and
  - at least one first latching element on the outside of a first lid side wall, and
- a holder comprising
  - a bottom part with a seat for the shell into which the refill pack can be inserted with the shell into an inserted position through the top insertion opening,
  - an outer lid that has a second lid base and second lid side walls projecting downward from the edges of the second lid base,
  - a first articulated connection between the outer lid and holder which is designed to pivot the outer lid into an open position that exposes the insertion opening for inserting the refill pack, and into a closed position that covers the insertion opening and accommodates the inner lid of a refill pack in the inserted position,
  - at least one support element projecting from the inside of at least one second lid side wall that, when in the closed position, engages below the bottom edge of at least one first lid side wall of a refill pack in an inserted position,
  - at least one second latching element on the inside of a second lid side wall which opposes the second lid side wall with the support element that, in the closed position, latches with the first latching element of a refill pack in the inserted position,
  - an unlocking button which penetrates a through-channel extending from the outside to the inside of the second lid side wall with the second latching element, wherein the unlocking button has an actuating element on the outside of the second lid side wall that can be actuated from the outside and a pressing element on the inside of the second lid side wall which, by actuating the actuating element, can be pressed against the outside of the first lid side wall having the first latching element of an inner lid locked to the outer lid in order to elastically deform this first lid side wall and undo the latching between the first and second latching element.

When the outer lid has swung into the open position, the refill package can be inserted with the shell into the seat of the holder. The shell and inner lid prevent contamination of the pipette tips. By swinging the outer lid into the closed position, the outer lid and inner lid are connected to each other so that the support element supports the bottom edge of a first side wall, and the first and second latching elements are latched to each other. Consequently, when the outer lid is subsequently opened, the inner lid can be lifted off of the refill pack, and pipette tips can be removed by means of a pipette. By swinging the outer lid into the closed position, the inner lid is again brought into its position covering the pipette tips. Consequently, the pipette tips are stored twice protected by the inner lid and outer lid. To release the inner lid from the outer lid, the unlocking button is merely actuated. The pressing element thereby exerts a force on the outside of the first lid side wall which has the first latching element. This bulges the first lid side wall inward so that the latching between the first and second latching element is released. The inner lid can fall out of the outer lid and return into the position covering the pipette tips. If the outer lid is arranged in the closed position when the latching is released, it can then be swung into the open position, wherein the inner lid remains in the position covering the pipette tips.

The perforated plate is a plate-shaped carrier with a substantially rectangular basic surface of plastic with a plurality of holes in a matrix arrangement. The perforated plate has most often 96 holes in 8 rows and 12 columns. Pipette tips are inserted from above into the holes, and they do not fall through the holes due to a diameter that is wider at the top, or a collar at their top end.

According to a preferred embodiment, the basic surface of the perforated plate and the arrangement of the holes in the perforated plate with 96 holes substantially corresponds to the basic surface of a microtiter plate and the arrangement of the wells of a microtiter plate with 96 wells according to the ANSI standard upon the recommendation of the Society for Biomolecular Screening (SBS). Consequently, a group of pipette tips that are picked up from the carrier by means of a multichannel pipette adapted to this standard can be directly aligned with a group of wells in a microtiter plate according to this standard. The perforated plate accordingly has two long edges (longitudinal sides) and two short edges (transverse sides).

According to a preferred embodiment, the inner lid and/or the shell has a rectangular contour with two long sides and two short sides in adaptation to conventional perforated plates with 96 holes in a horizontal section. According to a preferred embodiment, the outer shell and/or the seat have a rectangular shape with two long sides and two short sides adapted thereto in a horizontal section.

According to a preferred embodiment, the first articulated connection is arranged on a long side of the seat. According to a preferred embodiment, the first latching element is arranged on a long, first lid side wall, and the second latching element is arranged on a long second lid side wall, and the support element is arranged on an opposing, long lid side wall.

According to a preferred embodiment, the two first lid side walls that oppose each other are provided with a first latching element so that the refill pack can be inserted into the holder in two different alignments.

According to a preferred embodiment, the first latching element is a ledge on the bottom end of a first ramp on the outside of the first lid side wall whose distance from the first lid side wall increases as the distance from the lid base increases. The first ramp facilitates the latching of the inner lid to the outer lid, and the inner lid is securely held to the outer lid by the ledge. By pressing the pressing element against the outside of the first ramp, a force that presses the inner lid out of the outer lid can also be generated.

According to another embodiment, the second latching element is the bottom edge of the through-channel on the inside of the second lid side wall. The unlocking button with the pressing element can thereby be pressed against the first latching element or next to the first latching element, preferably directly adjacent to the first latching element, against the first lid side wall which facilitates the unlatching of the first latching element from the second.

According to another embodiment, the second latching element is a second ledge on the top side of a second ramp that projects from the inside of the second lid side wall and whose distance from the second lid side wall increases as the distance from the bottom edge of the second lid side wall increases. This facilitates the latching of the second latching element to the first latching element, and the second ledge establishes a secure latching.

According to another embodiment, the support element is a rib that projects from the inside of the second lid side wall with a third ledge on the top end for supporting the bottom edge of the first lid side wall.

By swinging the outer lid from the open position into the closed position, the support element can be moved below the bottom edge of the first lid side wall. According to a preferred embodiment, the support element is a third latching element that, when the outer lid is swung into the closed position, presses against the outside of the adjacent elastic first lid side wall of the inner lid and bends it slightly inward until it springs back above the third latching element. In an alternative embodiment, the support element is swung below the bottom edge of the first lid side wall without bending the lid side wall inward. Instead, the first and second latching elements are designed so that when they are latched, the inner lid is pushed over the support element so that when the outer lid is flipped open, the support element engages below the bottom edge of the adjacent first lid side wall.

According to another embodiment, the third latching element is a third ledge on the top end of a third ramp on the inside of the second lid side wall whose distance from the second lid side wall increases as the distance from the bottom edge of the second lid side wall increases. This embodiment facilitates the latching of the third latching element to the bottom edge of the adjacent first lid side wall.

According to another embodiment, the unlocking button is a lever that is pivotably mounted by a second articulated connection on the outer lid, that has the actuating element on the outside of a first lever arm, the pressing element on the inside of the first lever arm and, on the inside of a second lever arm, a latching lug which latches with a latching edge on the outside of the holder when the second cover is in the closed position. By latching the latching lug on the latching edge, the outer lid is held in the closed position. This latching is released by actuating the actuating element. Furthermore by actuating the actuating element, the pressing element is pressed against the inner lid, and this releases the latching between the inner lid and outer lid.

In an alternative embodiment, the unlocking button is a pin-shaped body which can be moved into the through-channel. In so doing, the through-channel can form a linear guide for the unlocking button.

According to a preferred embodiment, the unlocking button is designed such that, by actuating the actuating element along a first actuation path, the latching of the latching lug to the latching edge can be released, and by actuating the actuating element along an additional second actuation path, the latching of the inner lid to the outer lid can be released. This makes it possible for the user to release the outer lid from the holder by actuating the unlocking button along a short actuation path in order to swing open the outer lid together with the inner lid and remove pipette tips. Furthermore by actuating the actuating element along a longer actuation path, the user can release the outer lid from the holder and unseat the inner lid from the outer lid in order to remove, or respectively exchange, the refill pack.

According to a preferred embodiment, the first articulated connection has a horizontal pivot axis in order to swing the outer lid from above onto the inner lid, and upward away from the inner lid. According to another embodiment, the pivot axis is oriented parallel to the second lid side wall with the second latching element. This facilitates the latching of the first latching element to the second by swinging the outer lid closed. According to a preferred embodiment, the first articulated connection is arranged next to a second lid side wall which is arranged opposite the second lid side wall with the second latching element. This also facilitates the latching of the first latching element to the second.

According to another embodiment, the inner lid has a latching connection or clamping connection to the perforated plate. This secures the inner lid to the refill pack so that it does not unintentionally release.

According to another embodiment, the holder has at least one unlocking element which is designed to undo the latching connection or clamping connection between the inner lid and the perforated plate when inserting the refill pack into the holder. This simplifies the use of the device because the latching connection or clamping connection between the inner lid and perforated plate does not have to be undone when opening the outer lid in order to expose the pipette tips. This latching connection or clamping connection between the inner lid and perforated plate can be released when the refill pack is inserted into the holder because the inner lid can then no longer unintentionally be released from the refill pack. Alternatively, the latching connection or clamping connection between the inner lid and perforated plate can be undone by opening the outer lid, wherein this however requires a correspondingly strong latching connection between the outer lid and inner lid and a greater exertion of force.

According to another embodiment, the shell has a latching connection or clamping connection to the perforated plate. This prevents the shell from being unintentionally released when transporting the refill pack and avoids contamination. According to a preferred embodiment, the shell has latching hooks projecting from the top edge which latch with the edge of the perforated plate.

Possible embodiments of the shell are described in EP 2 535 109 A2. In this regard, reference is made to the above disclosure document, the content of which is hereby incorporated into this application. The present invention also includes other shells, in particular shells that have a greater rigidity than described in EP 2 535 109 A2.

According to a preferred embodiment, the perforated plate, and/or the shell, and/or the inner lid, and/or the holder consist entirely or partially of polypropylene, and/or polyethylene, and/or polycarbonate and/or acrylonitrile butadiene styrene copolymers, and/or polystyrene, and/or polyethylene terephthalate, and/or biodegradable plastics, and/or bio-based plastics, and/or composite films consisting of polyamide and polyethylene or polyethylene terephthalate and polyethylene. According to another embodiment, the pipette tips consist of polypropylene or polyethylene.

BRIEF DESCRIPTION OF THE DRAWINGS

The invention will be further explained below with reference to the accompanying drawings of exemplary embodiments. In the drawings.

DETAILED DESCRIPTION OF THE PREFERRED EMBODIMENTS

In this application, the designations "top" and "bottom" refer to an alignment of the device with a horizontal perforated plate, wherein the shell is arranged substantially below the perforated plate, and the inner lid is arranged substantially above the perforated plate. Furthermore, the insertion opening is aligned horizontally, and the outer lid is closed and arranged substantially above the bottom part.

Figure 1:
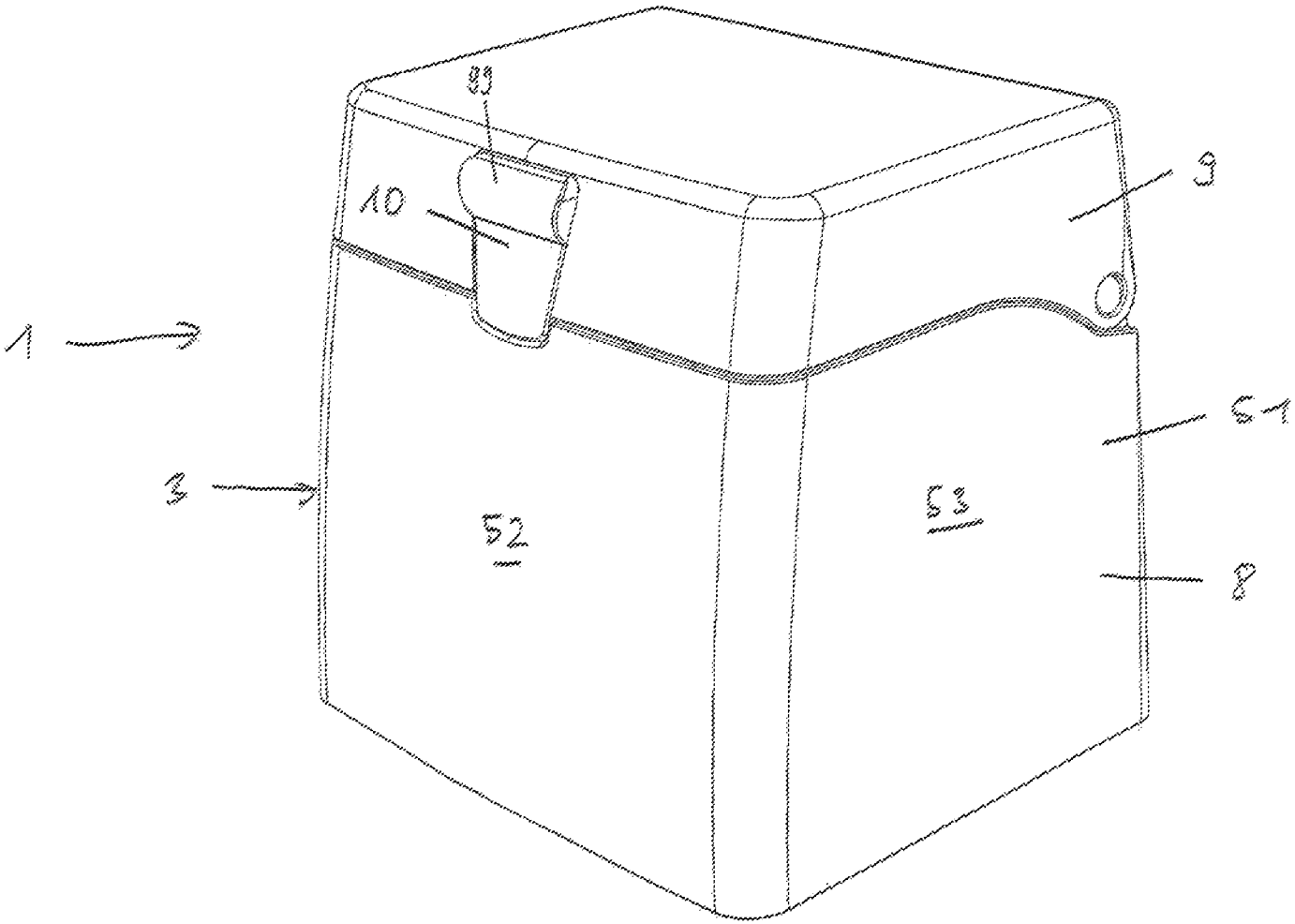
FIG. 1 shows a device for providing pipette tips comprising a refill pack and a holder in a closed state in a perspective view from the front and from the side.
Figure 2:
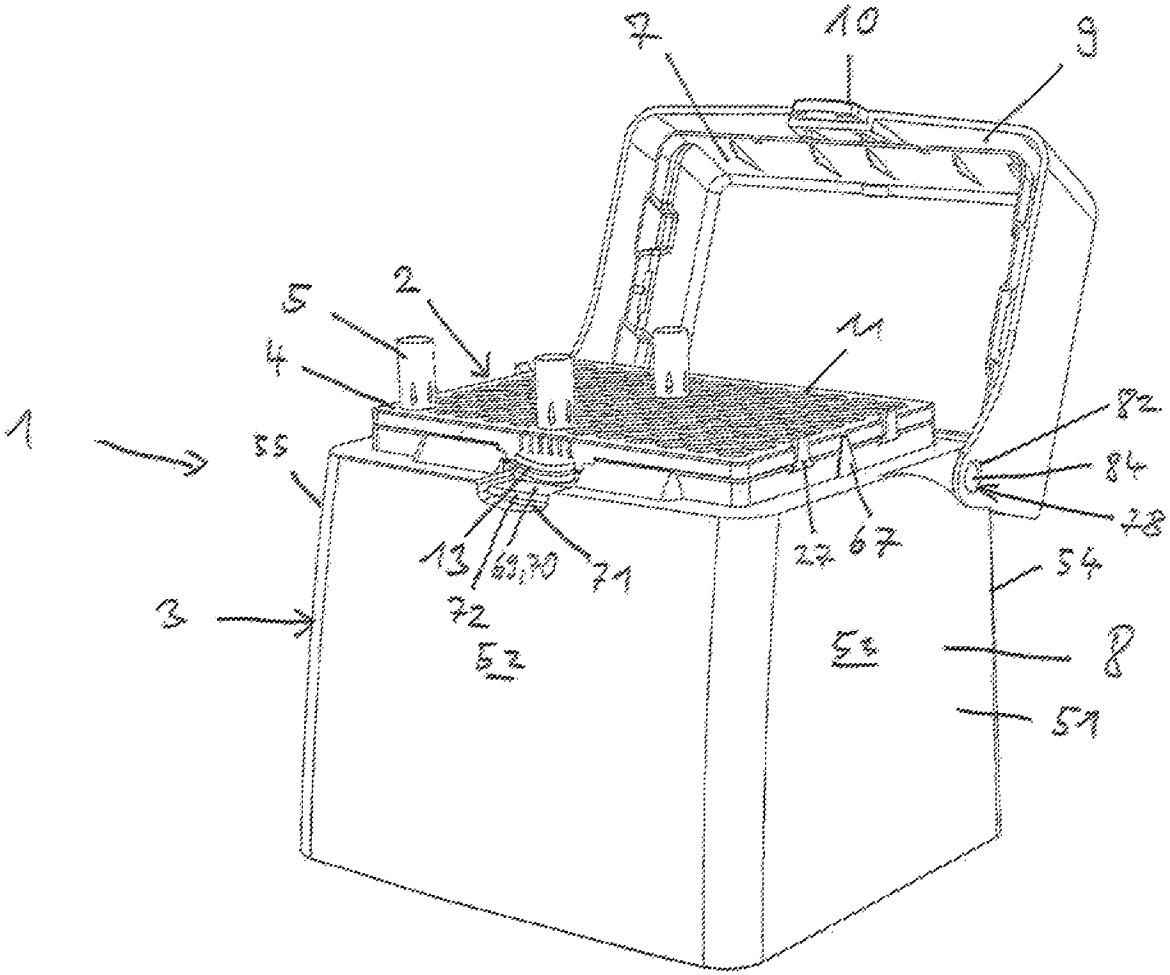
FIG. 2 shows the device in a perspective view from the front and from the side.

According to FIGS. 1 and 2, a device according to the invention for providing pipette tips 1 comprises a refill pack 2 and a holder 3 into which the refill pack 1 can be inserted.

According to FIGS. 3 to 5, the refill pack 2 comprises a perforated plate 4, pipette tips 5 inserted in the perforated plate 4, a shell 6 arranged below the perforated plate, and an inner lid 7 arranged above the perforated plate 4.

Figure 9:
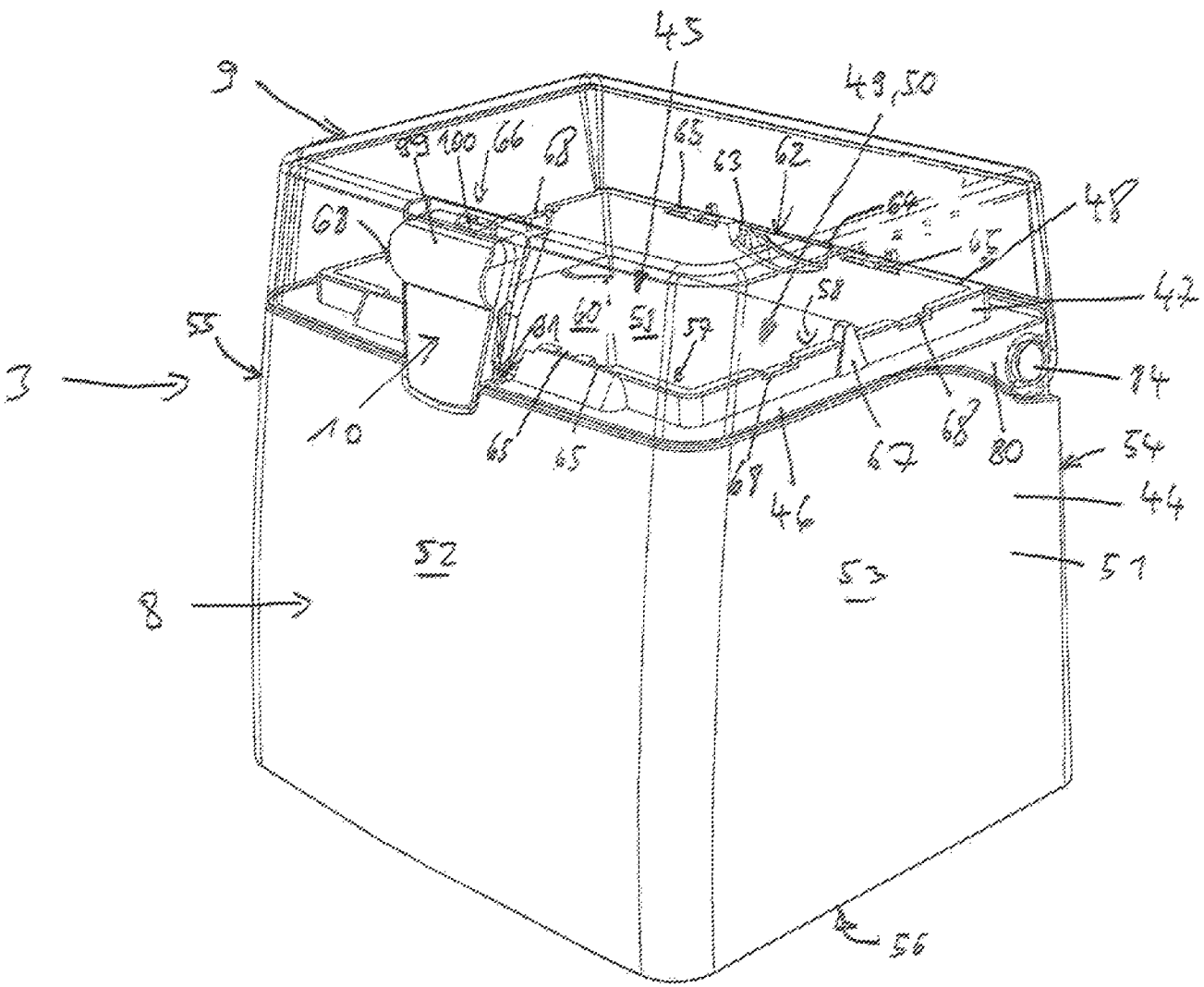
FIG. 9 shows the holder comprising the bottom part, outer lid and unlocking button closed, in a perspective view from the front and from the side.
Figure 10:
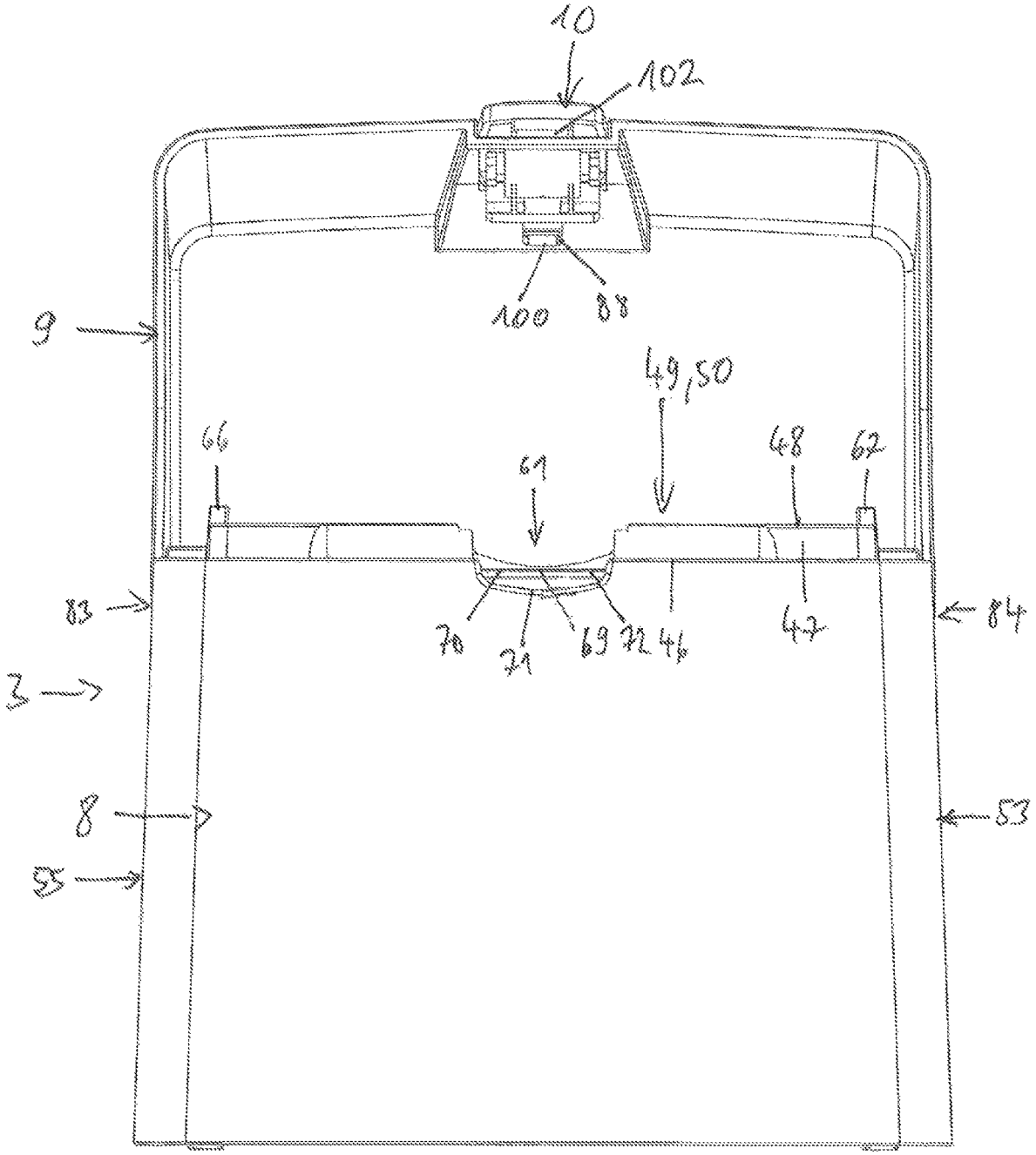
FIG. 10 shows the holder open in a front view.

According to FIGS. 9 and 10, the holder 3 has a bottom part 8, an outer lid 9 and an unlocking button 10.

Figure 6:
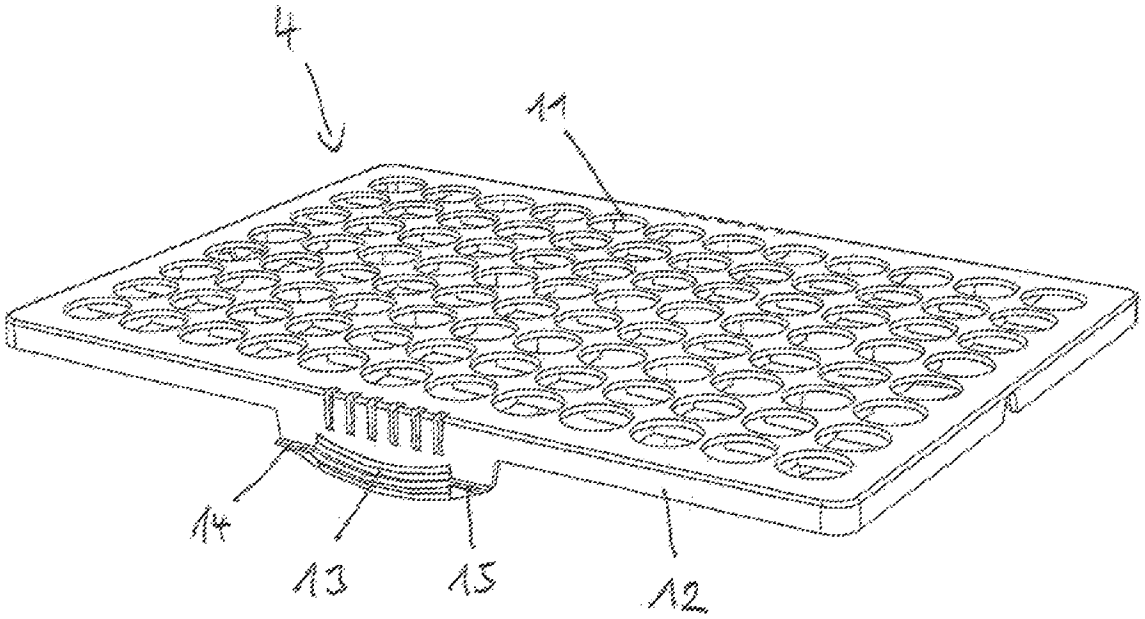
FIG. 6 shows the perforated plate in a perspective view from the front and from the side.

According to FIG. 6, the perforated plate 4 is a substantially rectangular plate that has a total of 96 circular holes 11 in eight rows and 12 columns.

The perforated plate 4 has a peripheral apron 12 that projects downward. Latching tabs 13 project downward from the apron 12 on the two longer longitudinal sides. The latching tabs 13 are arranged in about the middle of the two longer edges of the perforated plate 4. The latching tabs 13 each have first latching beads 14, 15 next to their two lateral edges.

The perforated plate 4 is produced from an elastic plastic so that the latching tabs 13 are elastically deformable. The perforated plate 4 is preferably produced by injection molding.

Figure 3:
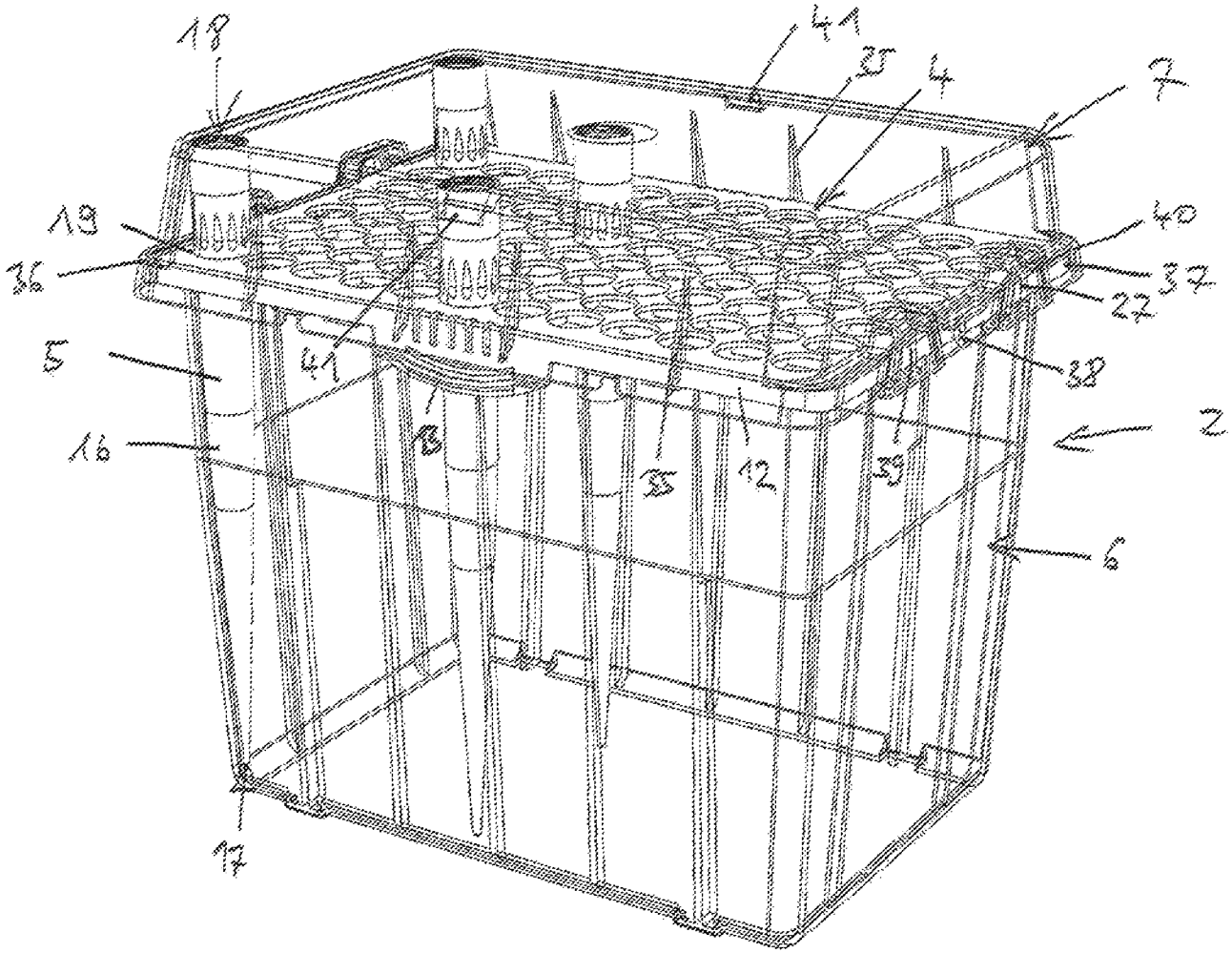
FIG. 3 shows the refill pack comprising the perforated plate, pipette tips, inner lid and shell closed, in a perspective view from the front and from the side.

According to FIG. 3, pipette tips 5 are inserted into the holes 11. These have a tubular body 16 with a bottom passage 17 and a top passage 18. Furthermore, they have a collar 19 by means of which they abut the perforated plate 4 at the top.

Figure 7:
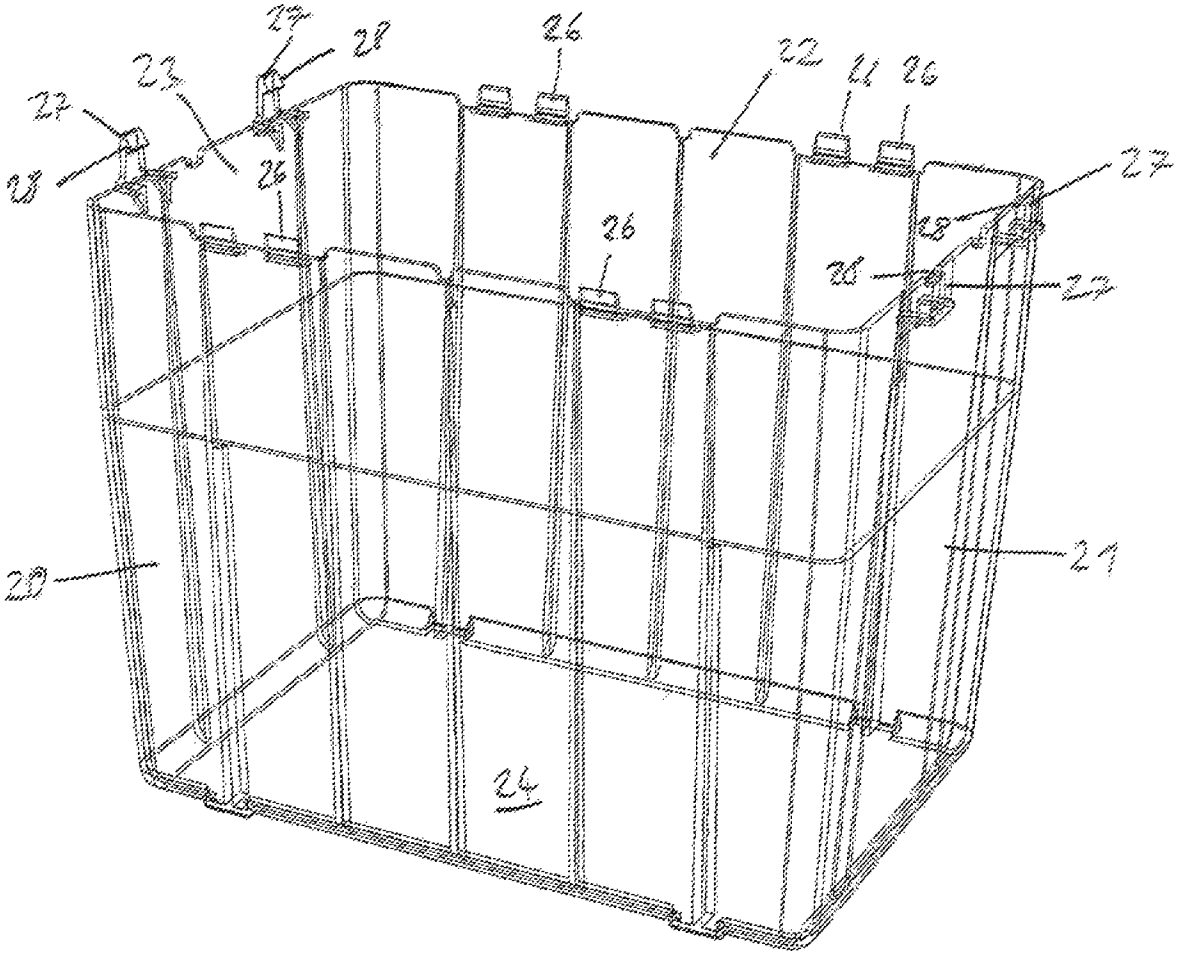
FIG. 7 shows the shell in a perspective view from the front and from the side.

According to FIG. 7, the shell 6 is substantially box shaped. In the exemplary embodiment, the distance between opposing shell side walls 20, 21, 22, 23 increases slightly starting from the shell base 24 up to a top shell opening 25 in the shell 6. The longer shell side walls 20, 22 each have two pairs of vertical centering projections 26 on the top edge. The centering projections 26 are each connected to the outside of a longer side wall 20, 22 so that they are slightly offset toward the outside relative to the side walls 20, 22.

The shorter side walls 21, 23 each have two projecting latching hooks 27 on the top edge, wherein the hook ends 28 are arranged on the side of the shell opening 25. The latching hooks 27 are each connected to the outside of a shorter side wall 21, 23 so that they are slightly offset toward the outside relative to the side walls 21, 23.

Figure 8:
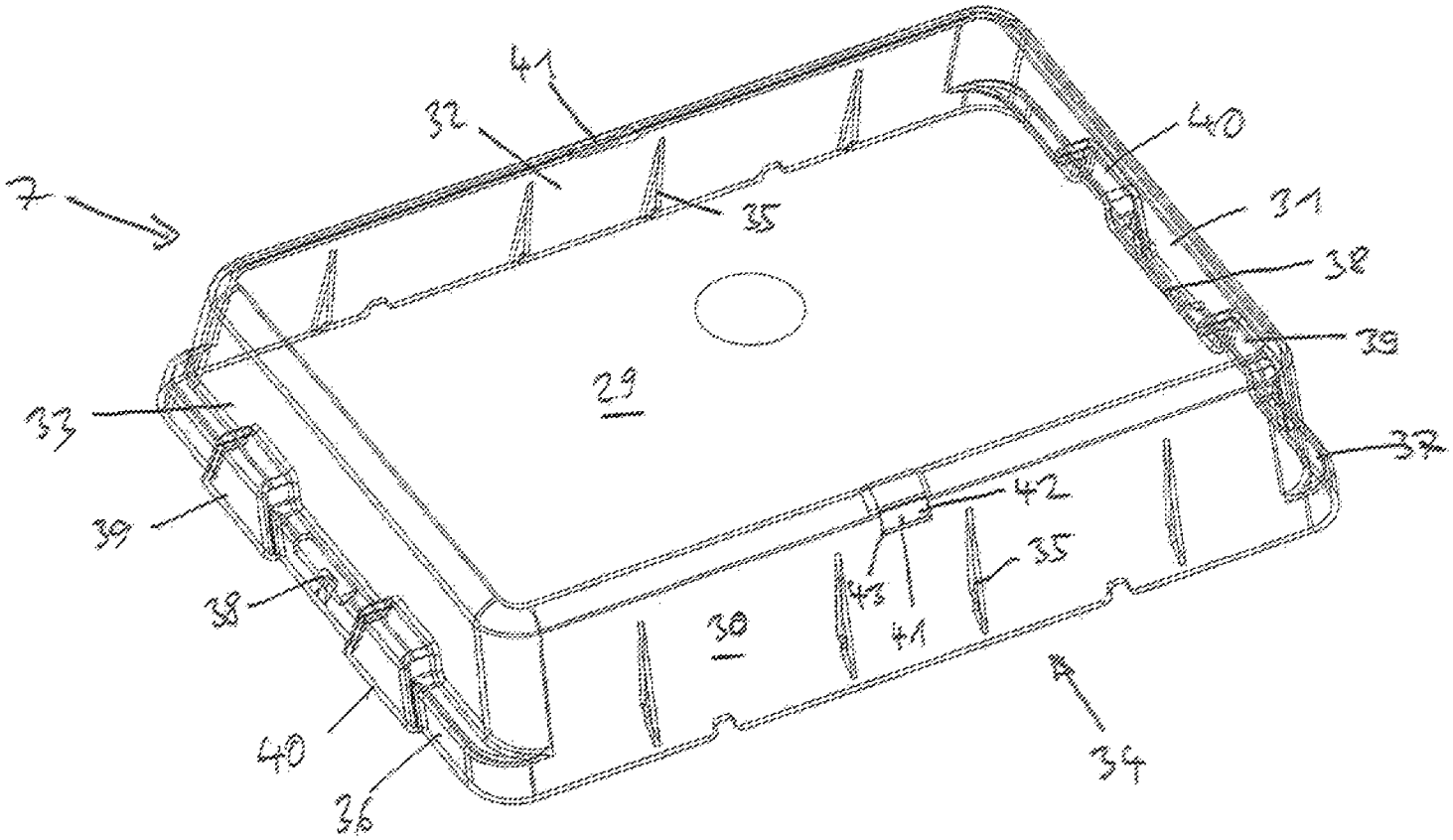
FIG. 8 shows the inner lid of the refill pack in a perspective view from the front and from the side.

According to FIG. 8, the inner lid 7 is formed like a hood, wherein the distance between mutually opposing first lid side walls 30, 31, 32, 33 starting from a first lid base 29 widens toward a first lid opening 34 in the inner lid 7.

The inner lid 7 has rib-shaped support elements 35 on the insides of the longer first lid side walls 30, 32 for supporting itself against the top edge of the perforated plate 4.

On its shorter longitudinal sides, the inner lid 7 has outer steps 36, 37 that project outward. On the insides of each of the outer steps 36, 37, there is an inwardly projecting clamping projection 38 below a penetration. The inside of each clamping projection 38 is sloped like a ramp so that each clamping projection 38 projects further inward as the distance from the bottom edge of the inner lid 7 increases. The inner lid 7 has two hood-shaped moldings 39, 40 in the region of each outer step 36, 37.

On each of its longer first lid side walls 30, 32, the inner lid 7 has an outwardly projecting first latching element 41 on the outside. Each first latching element 41 has a first ramp 42, the distance of which from the first lid side wall 30, 32 increases as the distance from the lid base 29 increases. Furthermore, each latching element 41 has a first ledge 43 at bottom.

Figure 4:
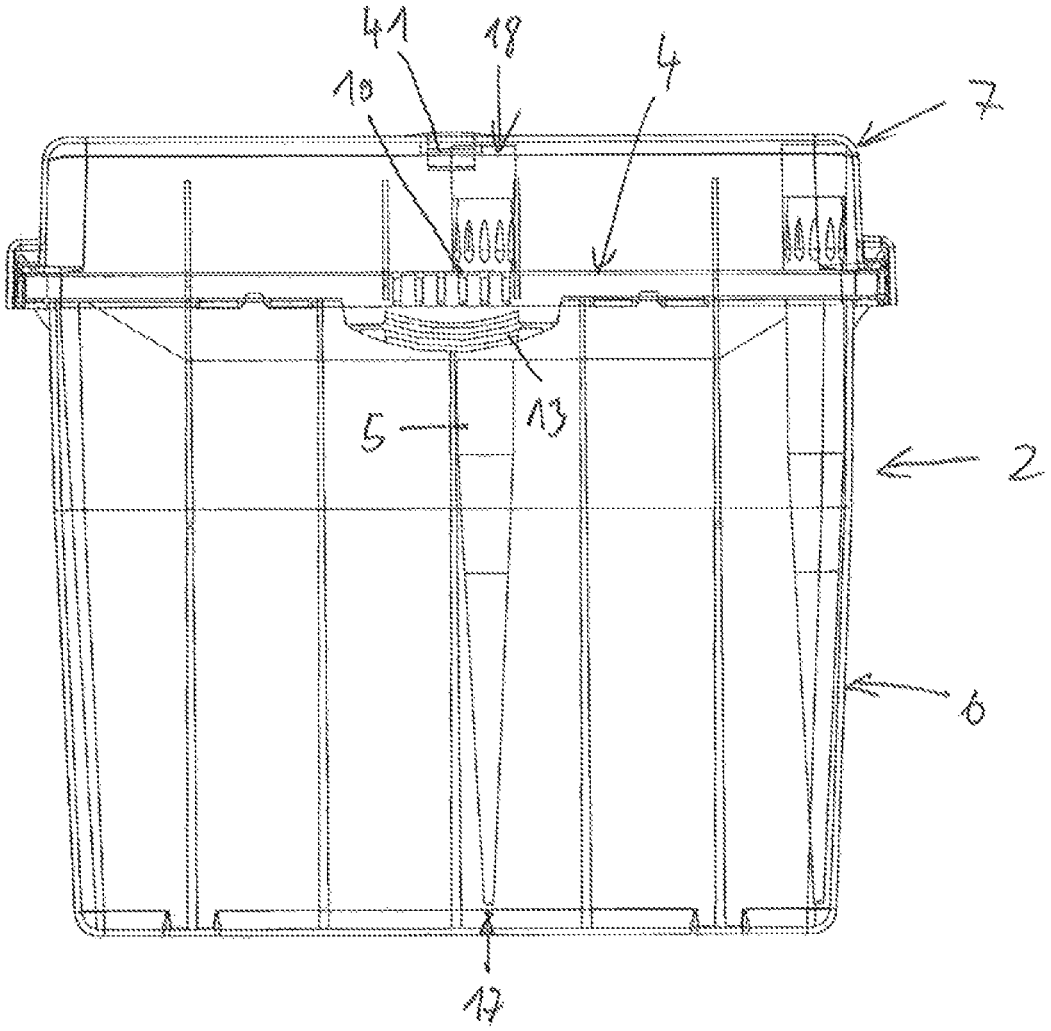
FIG. 4 shows the refill pack in a front view.
Figure 5:
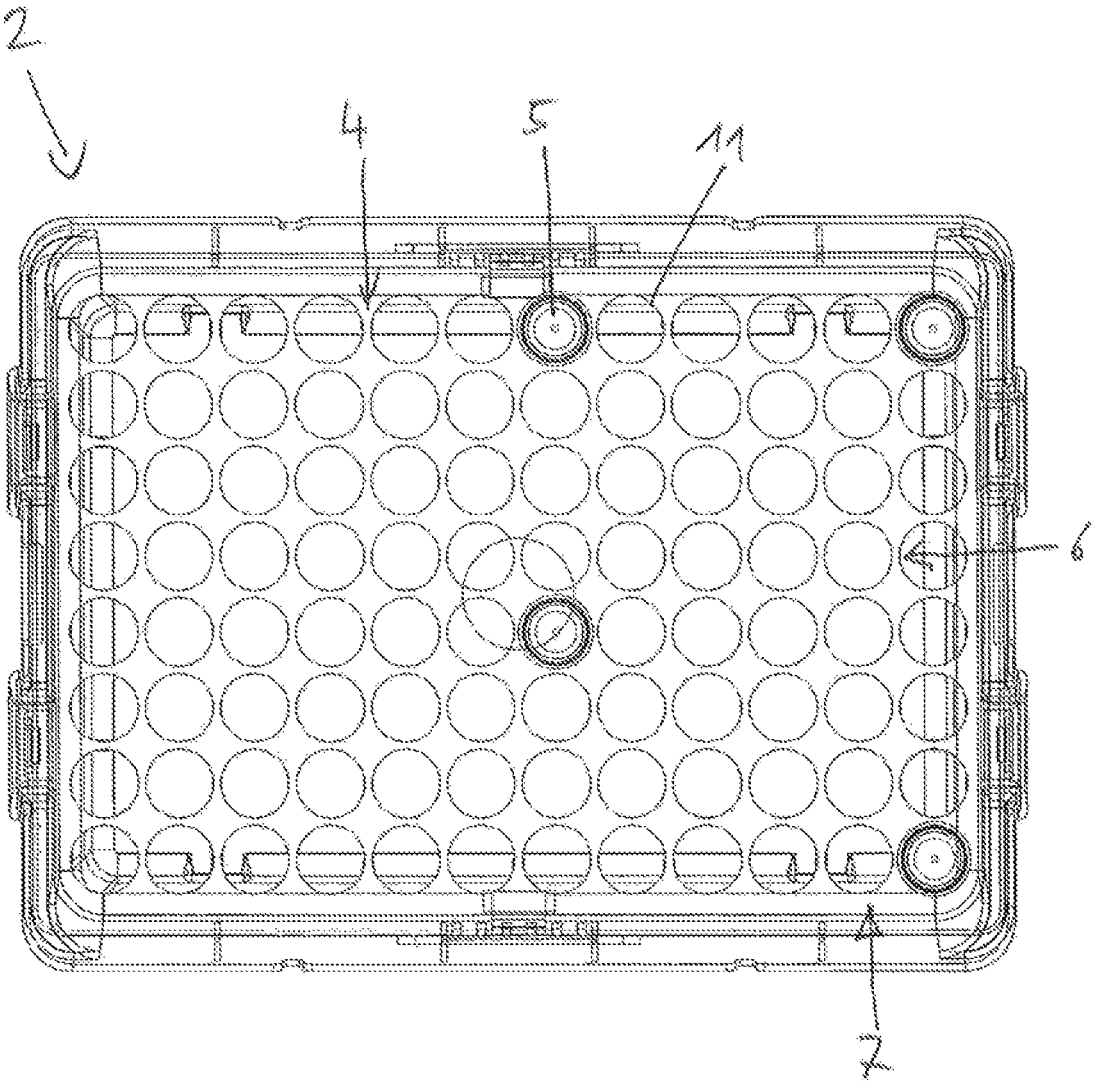
FIG. 5 shows the refill pack in a top view.

According to FIGS. 3 to 5, the perforated plate 4 is placed on the shell 6, wherein the centering projections 26 lie against the inside of the apron 12, and the latching hooks 27 grasp the outside of the shorter edges of the perforated plate 4 with the hook ends 28. The pipette tips 5 extend into the shell 6 and project by the top end beyond the perforated plate 4.

The perforated plate 4 is equipped with 96 pipette tips; however, only four are shown in the example.

The inner lid 7 is clamped by means of the clamping projections 38 onto the short edges of the perforated plate 4. With the rib-shaped support elements 35 and the outer steps 36, 37, the inner lid 7 supports itself on the edges of the perforated plate 4, and the latching hooks 27 engage in the hood-shaped moldings 39, 40.

According to FIGS. 9 and 10, the bottom part 8 of the holder 3 comprises a frame 44 and a trough 45.

The frame 44 comprises a substantially horizontal, top frame part 46.

The trough 45 projects downward from the inner edge of the top frame part 46. Furthermore, a support frame 47 with a substantially horizontal top mounting edge 48 projects upward from the inner edge of the top frame part 46. The support frame 48 and the trough 45 surround a substantially cuboid-shaped seat 49. The mounting edge 46 of the support frame 47 surrounds an insertion opening 50 in the seat 49.

The frame 44 comprises a casing 51 that projects downward from the outer edge of the top frame part 46 and encloses the trough 45. The casing 51 has four casing walls 52, 53, 54, 55, wherein the distance of the casing walls 52, 53, 54, 55 facing each other increases downward. The casing 51 projects downward the same distance or slightly further than the trough 45 from the top frame part 46.

The trough 45 is substantially cuboid. It has a substantially horizontal, rectangular trough base 56. From the edges of the trough base 56, trough walls 57, 58, 59, 60 project upward, the top edges of which are connected to the inner edge of the top frame part 46. Starting from the trough base 56, the distance of the trough walls 57, 58, 59, 60 that face each other increases upward.

On two long edges, the support frame 47 has first recesses 61, 62 centered on each edge with a base that bulges downward. The first recesses 61, 62 each have inwardly projecting second latching beads 63, 64 (FIG. 9) on the two vertical, lateral edges. The support frame 47 has a pair of centering pockets 65 on the two long edges on both sides of the first recess 61, 62 that open toward the mounting edge 48 and are open toward the inside of the support frame 47.

Arranged on the short edges of the support frame 47 is a wedge-shaped projection 66, 67 that tapers upward, extends beyond the mounting edge 48 at the top, and project slightly beyond the support frame 47. On each of the short edges, the support frame 47 has a rectangular second recess 68 on both sides of the projection 66, 67 in the mounting edge 48.

On the front side bordering the first recess 61, the top frame part 46 has a substantially rectangular third recess 69 with a flat, first base 70. From the front, the third recess 69 extends into a front casing wall 52. There, it has a downwardly bulging second base 71. At the front edge of the first base 70, the third recess 69 has a latching edge 72 (FIG. 2.) which projects slightly into the continuation of the third recess 69 into the front casing wall 52.

The trough 45 and frame 44 are for example injection molded separately and connected to each other, for example by latching, or produced as a single part in an injection molding method.

Figure 11:
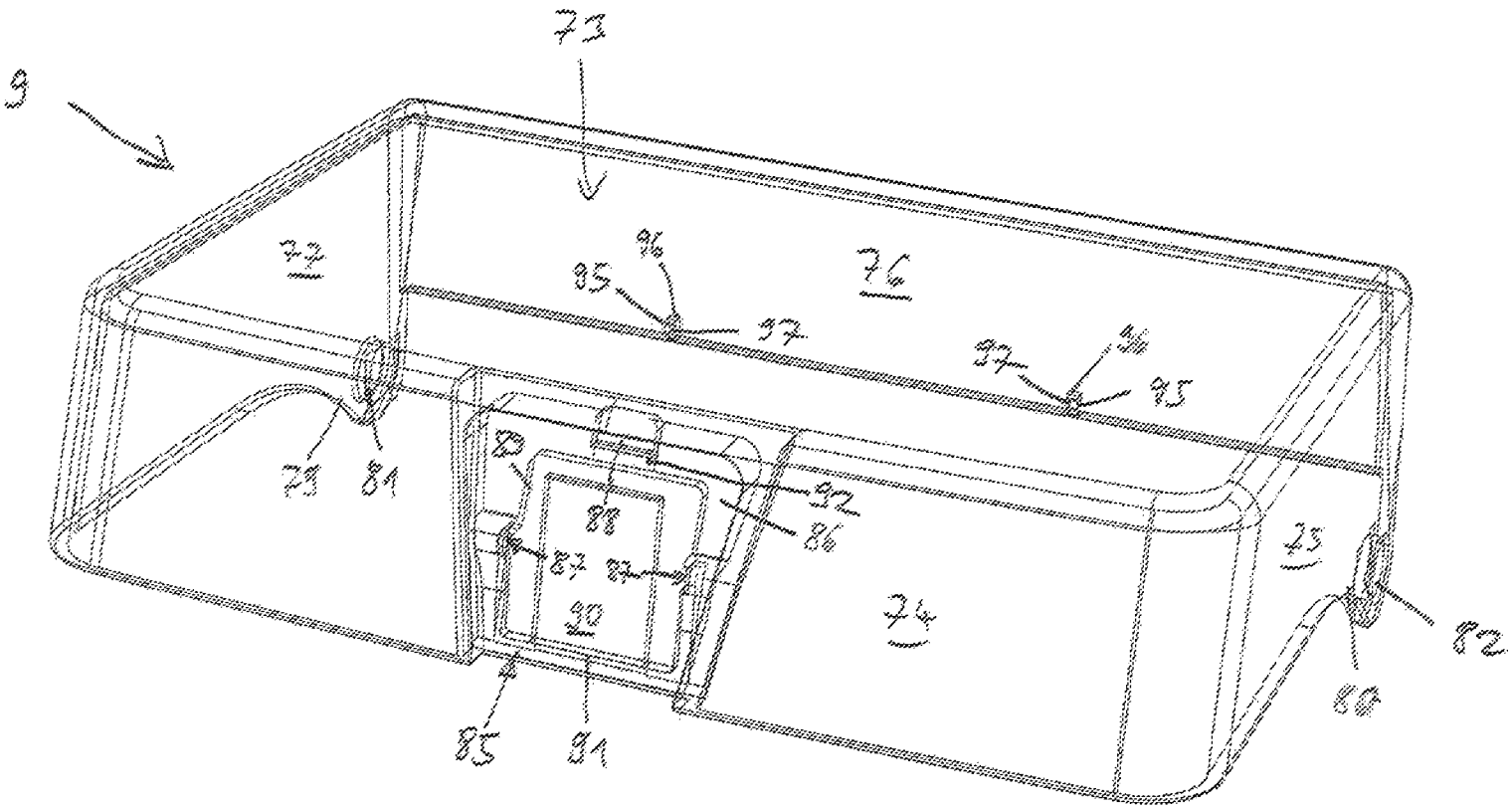
FIG. 11 shows the outer lid in a perspective view from the front and from the side.

According to FIG. 11, the outer lid 9 has a second lid base 73 and second lid side walls 74, 75, 76, 77 that project downward from the edges of the second lid base 73.

The outer lid 9 is pivotably mounted by a first articulated connection 78 to the bottom part 8. The first articulated connection 78 comprises tab-shaped wall projections 79, 80 with first bearing eyes 81, 82 of the outer lid 9 that project from the bottom edges of the short, second lid side walls 75, 77 next to a long second side wall 76. Furthermore, they comprise first bearing bolts 83, 84 projecting on the top edges of the two short casing walls 53, 55 next to the rear, long casing wall 54. The casing walls 53, 55 are slightly flattened around the first bearing bolts 83, 84 in order to accommodate the wall projections 79, 80 so that the casing 51 and outer lid 9 transition smoothly into each other when the first bearing bolts 83, 84 are mounted in the first bearing eyes 81, 82.

In one long second lid side wall 74, the outer lid 9 has a fourth recess 85 in the outside which is open to the top at the top edge of the second lid side wall 74 and to the bottom at the bottom edge. In the example, the fourth recess 85 is trapezoidal, wherein it expands from bottom to top.

The fourth recess 85 has a frame-shaped base region 86.

On the two vertical edges of the frame-shaped base region 86, the fourth recess 85 has two bearing eyes 87.

Furthermore close to the top edge of the fourth recess 85, there is a through-channel 88 with a nearly rectangular cross-section that extends from the outside to the inside of the frame-shaped base region 86.

The fourth recess 85 has an approximately rectangular, central base region 90 in a rectangular cutout 89 that is surrounded by the frame-shaped base region 86. The central base region 90 is securely connected to the frame-shaped base region 86 only at the bottom base edge 91. It can be elastically deflected.

Figure 15:
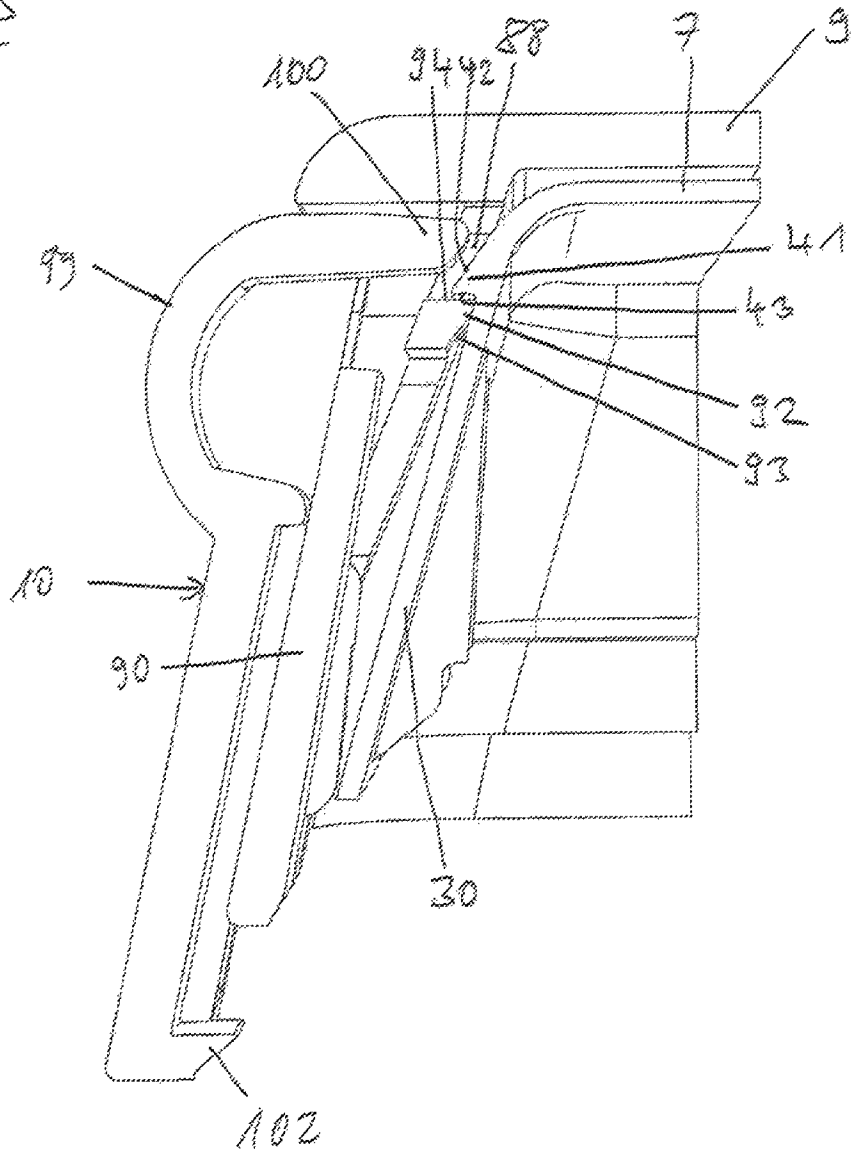
FIG. 15 shows an enlarged detail with the unlocking button from FIG. 14.
Figure 16:
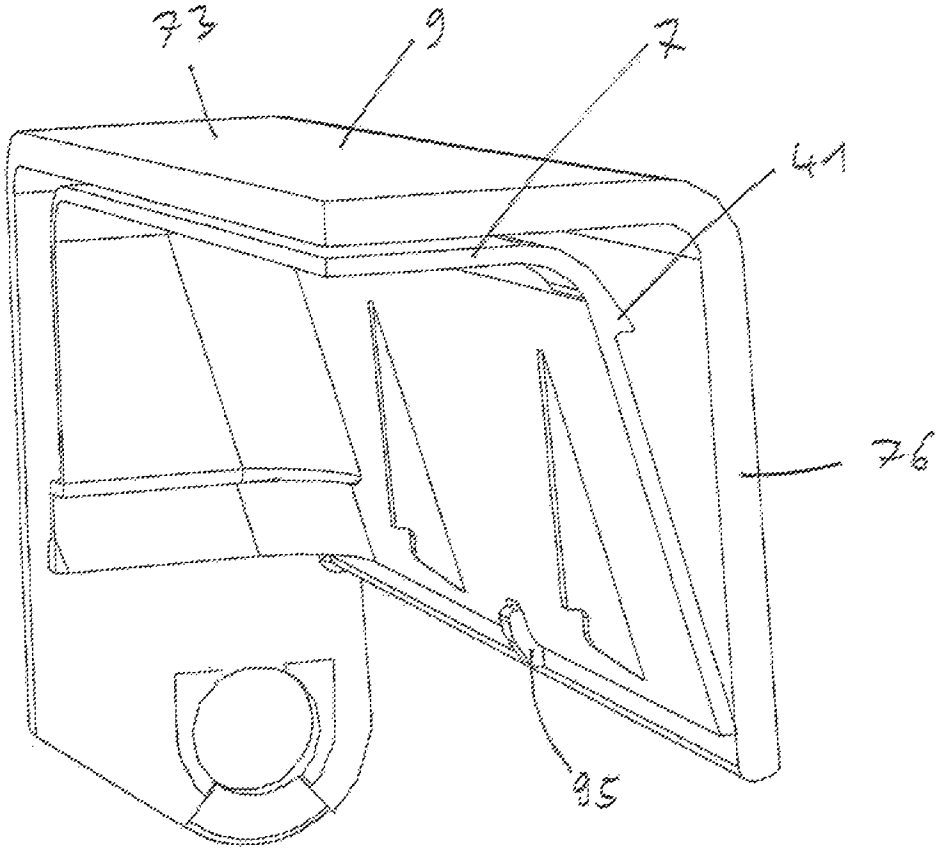
FIG. 16 shows a cutaway corner region of the inner lid and outer lid in a perspective view diagonally from the top and from the side.

Below the through-channel 88, a second latching element 92 with a second ramp 93 projects from the inside of the second lid side wall 74, and its distance from the second lid side wall 74 increases as the distance from the bottom edge of the second lid side wall 74 increases. At the top, the second latching element 92 has a second ledge 94 (FIG. 15).

The outer lid 9 has support elements that project from the inside of the other long second lid side wall 76 (FIG. 11). These are arranged on the bottom edge of the second lid side wall 76. They are each designed as third latching elements 95 with a third ledge 96 on the top end and a third ramp 97 on the inside of the second lid side wall 76 and their distance from the second lid side wall 76 increases as the distance from the bottom edge of the second lid side wall 76 increases.

The outer lid 9 is preferably injection molded as a single part from plastic.

Figure 12:
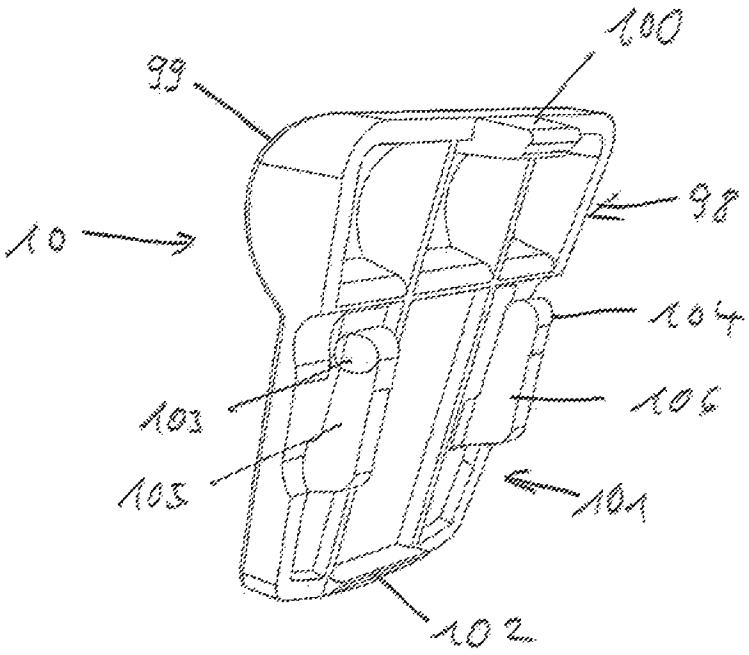
FIG. 12 shows the unlocking button in a perspective view from the front and from the side.
Figure 13:
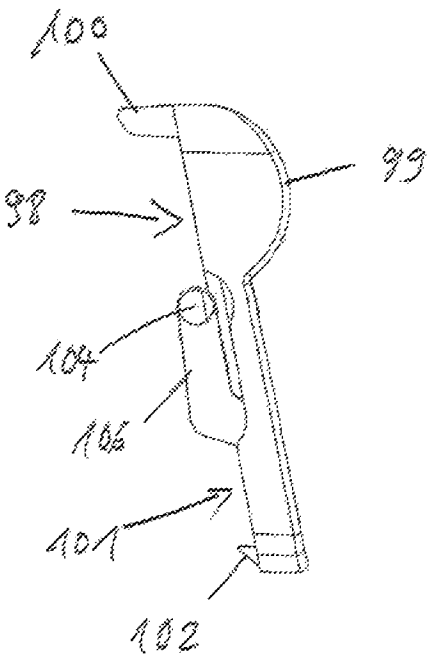
FIG. 13 shows the unlocking button in a side view.

According to FIGS. 12 and 13, the unlocking button 10 is a two-arm lever, wherein a first lever arm 98 has a barrel-shaped, outwardly bulging actuation element 99 on the outside, and a projecting pressing element 100 on the inside at the top end. The pressing element 100 is designed in the shape of an incisor in the example. A second lever arm 101 is substantially plate-shaped and has a latching lug 102 projecting from the inside at the bottom end.

Between the first and second lever arm 98, 101, there are two horizontal second bearing bolts 103, 104 arranged on the inside of the unlocking button 10. These project from the ends of two parallel, tab-like bearing carriers 105, 106 in different directions which are securely connected further downward by their other ends to the inside of the second lever arm 101.

The unlocking button 10 is preferably injection molded as a single part from a plastic. The bearing carriers 105, 106 are elastically deformable.

According to FIGS. 9 and 10, the unlocking button 10 is mounted by the second bearing bolt 103, 104 in the second bearing eyes 87. The actuating element 99 is arranged at the top, and the latching lug 102 is arranged at the bottom.

Figure 14:
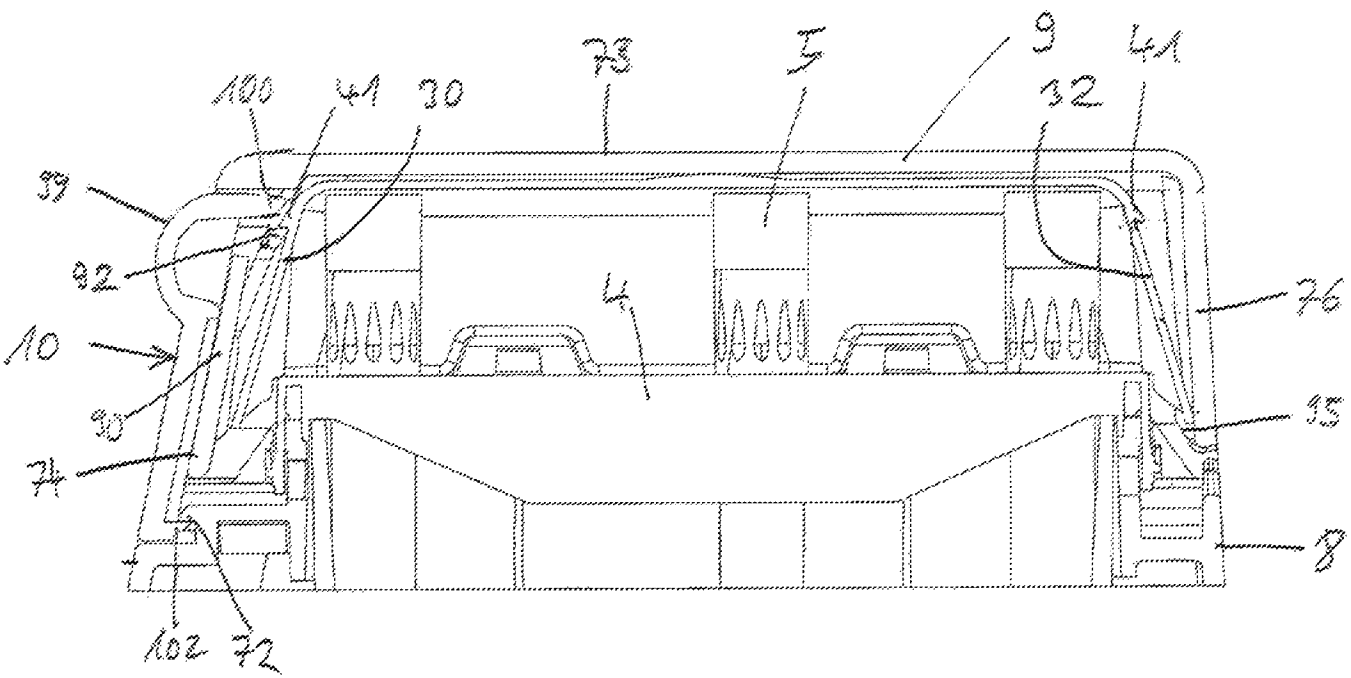
FIG. 14 shows the device comprising the refill pack and holder closed in a vertical section of a top region.

The inside of the first lever arm 98 of the unlocking button 10 lies against the central base region 90 of the fourth recess 85 (FIG. 14, 15) below the pressing element 100. The pressing element 100 penetrates the through-channel 88. When the outer lid 9 is closed, the latching lug 102 latches with the latching edge 72. In so doing, the elastic bulging of the central base region 90 permits a deflection of the unlocking button 10 outward until the latching lug 102 latches with the latching edge 72.

Upon pressing from the outside against the actuating element 99, the pressing element 100 extends further from the inside of the second lid side wall 74. In so doing, the central base region 90 is elastically deflected inward so that it resets the unlocking button 10 back into the home position after relieving the actuating element 99.

The device can be used as follows:

By pressing against the actuating element 99 of the unlocking button 10, the latching of the latching lug 102 and latching edge 972 of the closed device according to FIG. 1 can be released so that the outer lid 9 can be swung open into the open position as shown in FIGS. 2 and 10.

The refill pack 2 in FIGS. 3 to 5 is inserted into the seat 49 through the insertion opening 50 with the shell 6 in front until the bottom edge of the perforated plate 4 sits on the mounting edge 48. The inserted position is then reached. Then the latching tabs 13 engage in the first recesses 61, 62, the first latching beads 14, 15 latch with the second latching beads 63, 64, the centering projections 26 engage in the centering tabs 65, and the latching hooks 27 engage in the second recesses 68. Furthermore upon inserting the refill pack 2, the wedge-shaped projections 66, 67 press from below against of the clamping projections 38 and release the inner lid 7 from the perforated plate 4.

When the outer lid 9 is closed into the closed position, the first and second latching elements 41, 92 latch with each other, and the third latching element 95 latches with the bottom edge of the first lid side wall 32. Furthermore, the latching lug 102 latches with the latching edge 72. The device is shown in this situation in FIGS. 1 and 14.

Figure 17:
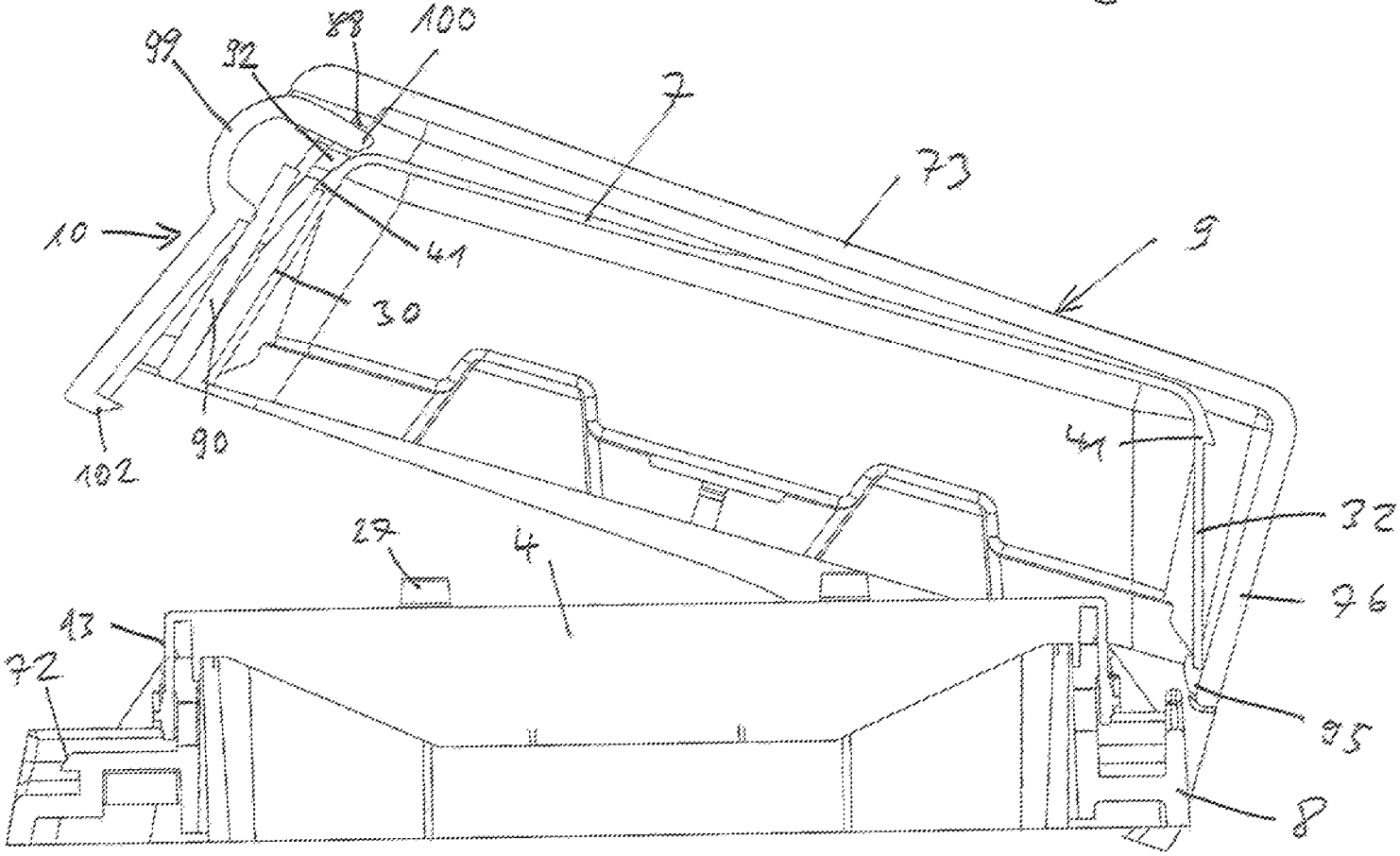
FIG. 17 shows the device partially opened in a vertical section of the top region.

By pressing the actuating element 99 a short distance, the outer lid 9 can be unlatched and swung upward together with the latched inner lid 7 in order to remove pipette tips 5. The device is shown in FIG. 17 while opening. In FIG. 2 it is completely open, and the outer lid 9 is in the insertion position. In the insertion position, the outer lid 9 is completely open, and the wall projections 79, 80 lie by their rear edges against the bottom edges of the flat regions around the first bearing bolts 83, 84 of the short casing walls 53, 55.

After the pipette tips 5 are removed, the outer lid 9 can again be closed.

Figure 18:
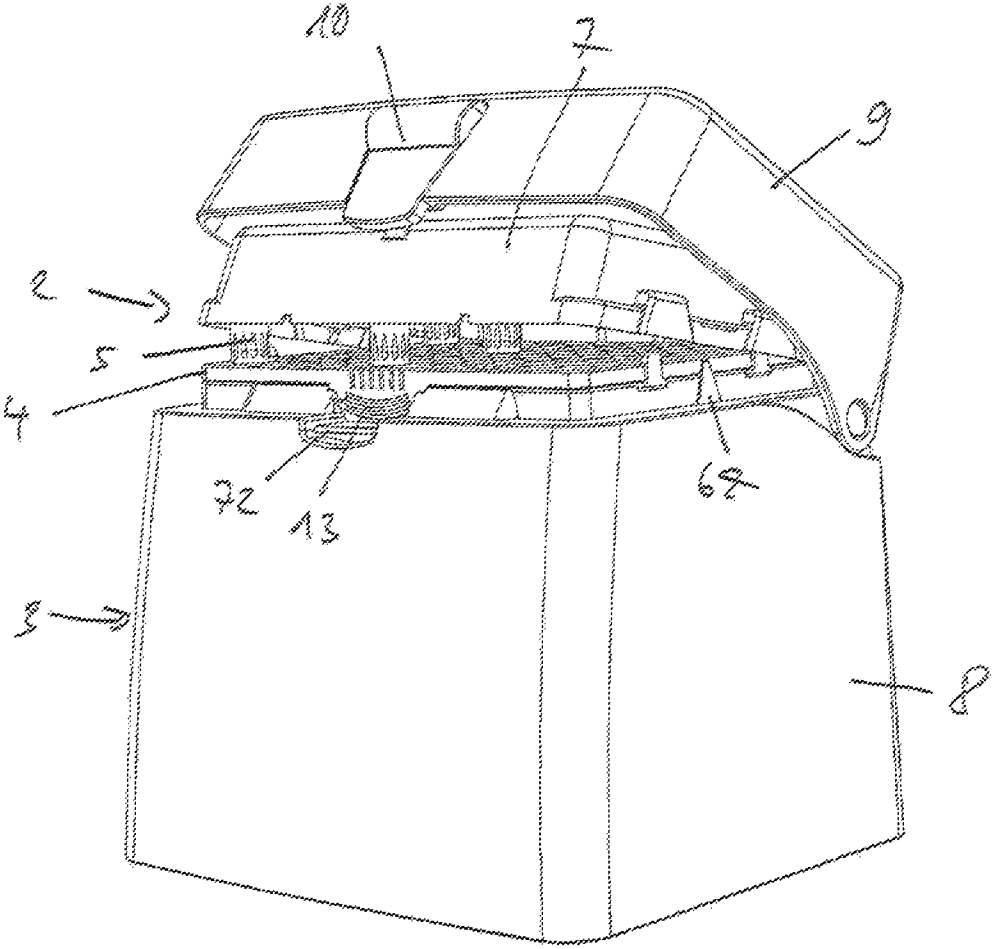
FIG. 18 shows the device partially opened when unseating the inner lid in a perspective view diagonally from the front and from the side.
Figure 19:
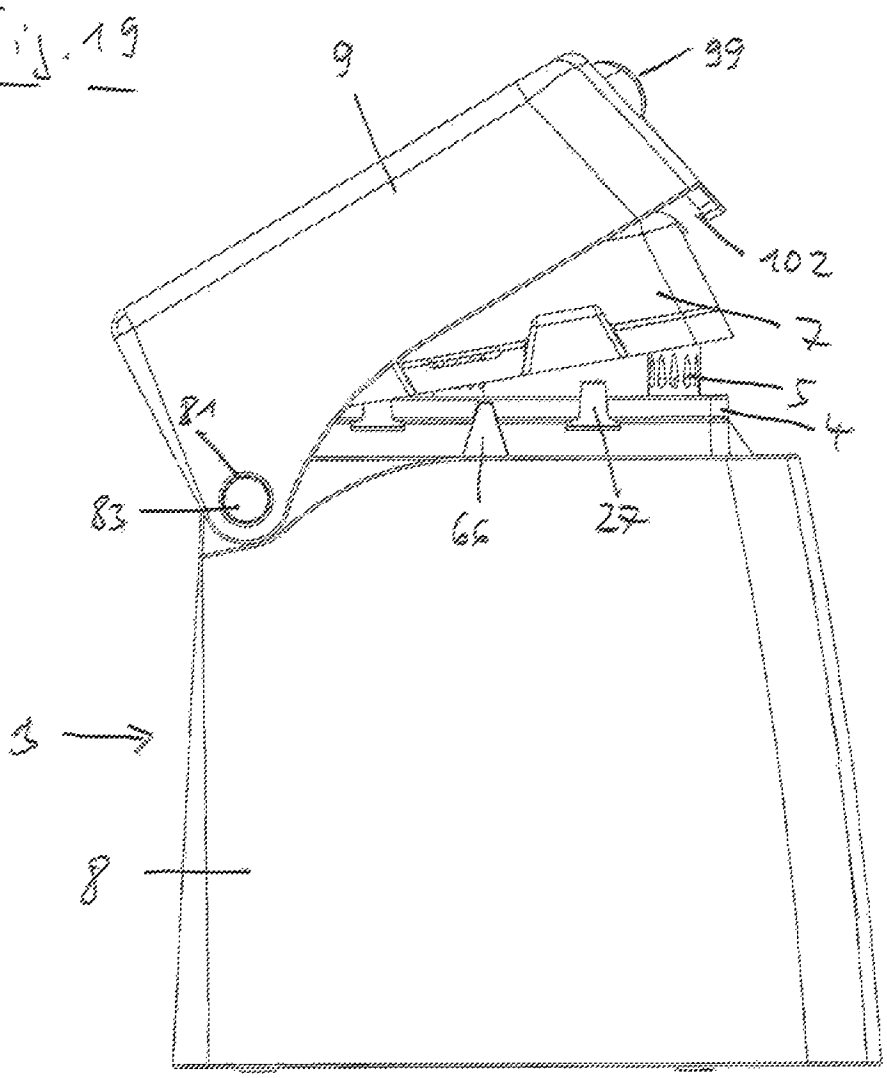
FIG. 19 shows the device in the state from FIG. 18 in a side view.

In order to exchange the refill pack 2, the actuating element 99 is pressed deeper so that the pressing element 100 presses from the outside against the first lid side wall 30 by the first latching element 41. This bends the first lid side wall 30 inward, and the first latching element 41 is freed from the second latching element 92. The inner lid 7 drops down as shown in FIGS. 17, 18 and 19.

The user can press from above against the inner lid 7 in order to securely clamp it to the perforated plate 4. Then he can unlatch the latching lugs 13 by pressing inward and remove the refill packs 2.

The holder 3 is then ready for inserting a fresh refill pack 2.

REFERENCE SIGN LIST

1 Device
2 Refill pack
3 Holder
4 Perforated plate
5 Pipette tip
6 Shell
7 Inner lid
8 Bottom part
9 Outer lid
10 Unlocking button
11 Holes
12 Apron
13 Latching tabs
14, 15 First latching bead
16 Body
17 Bottom passage
18 Top passage
19 Collar
20, 21, 22, 23 Shell side walls
24 Shell base
25 Shell opening
26 Centering projection
27 Latching hook
28 Hook end
29 First lid base
30, 31, 32, 33 First lid side wall
34 Lid opening
35 Support element
36, 37 Outer step
38 Clamping projection
39, 40 Hood-shaped molding
41 First latching element
42 First ramp
43 First ledge
44 Frame
45 Trough
46 Upper frame part
47 Support frame
48 Mounting edge
49 Seat
50 Insertion opening
51 Casing
52, 53, 54, 55 Casing wall
56 Trough base
57, 58, 59, 60 Trough wall
61, 62 First recess
63, 64 Second latching bead
65 Centering pocket
66, 67 Wedge-shaped projection
68 Second recess
69 Third recess
70 First base
71 Second base
72 Latching edge
73 Second lid base
74, 75, 76, 77 Second lid side wall
78 First articulated connection
79, 80 Tab-shaped wall projection
81, 82 Bearing eyes
83, 84 Bearing bolts
85 Fourth recess
86 Frame-shaped base region
87 Second bearing eye
88 Through-channel
89 Cutout
90 Central base region

We claim:

1. A device for providing pipette tips comprising:

a refill pack (2) comprising a perforated plate (4) with a plurality of holes (11), pipette tips (5) inserted in the holes (11), a shell (6) covering the pipette tips (5) below the perforated plate, an inner lid (7) consisting of an elastic material covering the pipette tips (5) above the perforated plate (4) that has a first lid base (29) and first lid side walls (30 to 33) projecting downward from edges of the first lid base (29), and at least one first latching element (41) on an outside of a first lid side wall (30), and a holder (3) comprising a bottom part (8) with a seat (49) for the shell (6) into which the refill pack (2) can be inserted with the shell (6) into an inserted position through a top insertion opening (50), an outer lid (9) that has a second lid base (73) and second lid side walls (74 to 77) projecting downward from edges of the second lid base (73), a first articulated connection (78) between the outer lid (9) and holder (3) which is designed to pivot the outer lid (9) into an open position that exposes the insertion opening (50) for inserting the refill pack (2), and into a closed position that covers the insertion opening and accommodates the inner lid (7) of the refill pack (2) in the inserted position, at least one support element (95) projecting from the inside of at least one second lid side wail (76) that, when in the closed position, engages below a bottom edge of at least one first lid side wall (32) of the refill pack (2) in the inserted position, at least one second latching element (92) on an inside of a first second lid side wall (74) which opposes a second, second lid side wall (76) with the at least one support element (95) that, in the closed position, latches with the first latching element (41) of the refill pack (2) in the inserted position, and an unlocking button (10) which penetrates a through-channel (88) extending from outside to inside of the first second lid side wall (74) with the at least one second latching element (92), wherein the unlocking button (10) has an actuating element (99) on the outside of the first second lid side wall (74) that can be actuated from the outside and a pressing element (100) on the inside of the first second lid side wall (74) which, by actuating the actuating element (99), can be pressed against the outside of the first lid side wall (30) having the first latching element (41) of the inner lid (7) locked to the outer lid (9) in order to elastically deform the first lid side wall (30) and undo the latching between the at least one first and at least one second latching element (41, 92).

2. The device according to claim 1, wherein two of the first lid side walls (30, 32) face each other and each has at least one first latching element (41).

3. The device according to claim 1, wherein the at least one support element (95) is arranged on a long second lid side wall (76), and at least one second latching element (92) is arranged on an opposing second lid side wall (74) of the outer lid (9).

4. The device according to claim 1, wherein the at least one first latching element (41) is a ledge on a bottom end of a first ramp (42) on the outside of the first lid side wall (30) whose distance from the first lid side wall (30) increases as the distance from the first lid base (29) increases.

5. The device according to claim 1, wherein the at least one second latching element (92) is a bottom edge of the through-channel (88) on the inside of the first second lid side wall (74).

6. The device according to claim 1, wherein the at least one second latching element (92) is a second ledge (94) on the top side of a second ramp (93) that projects from the inside of the second lid side wail (74), and whose distance from the first second lid side wall (74) increases as the distance from the bottom edge of the first second lid side wall (74) increases.

7. The device according to claim 1, wherein the at least one support element is a third latching element (95) that, when the outer lid (9) is swung into the closed position, latches with a bottom edge of an adjacent first lid side wall (32) of the inner lid (7).

8. The device according to claim 7, wherein the third latching element (95) is a third ledge (96) on a top end of a third ramp (97) on the inside of a second lid side wall (76), and whose distance from the second lid side wall (76) increases as the distance from a bottom edge of the second lid side wall (76) increases.

9. The device according to claim 1, wherein the unlocking button (10) is a lever that is pivotably mounted by a second articulated connection (103, 104, 105, 106) on the outer lid (9) which has the actuating element (99) on the outside of a first lever arm (98), the pressing element (100) on an inside of the first lever arm (98) and, on an inside of a second lever arm (101), a latching lug (102) which latches with a latching edge (72) on the outside of the holder (3) when the outer lid (9) is in the closed position.

10. The device according to claim 9, wherein the unlocking button (10) is designed such that, by actuating the actuating element (99) along a first actuation path, the latching of the latching lug (102) to the latching edge (72) can be released, and by actuating the actuating element (99) along an additional second actuation path, the latching of the inner lid (7) to the outer lid (9) can be released.

11. The device according to claim 1, wherein the inner lid (7) has a latching connection or clamping connection to the perforated plate (4).

12. The device according to claim 11, wherein the clamping connection has at least one clamping projection (38) that projects from the inside of a first lid side wall (31, 33).

13. The device according to claim 11, wherein the holder (3) has at least one unlocking element which is designed to undo the latching connection or clamping connection between the inner lid (7) and the perforated plate (4) when inserting the refill package (2) into the holder (3).

14. The device according to claim 12, wherein the unlocking element is a projection (67) that projects from the bottom part (8) and which the clamping projection (38) contacts when the refill pack (2) is inserted into the inserted position.

15. The device according to claim 1, wherein the shell (6) has a latching connection or clamping connection to the refill pack (2).

* * * * *